US006425606B1

(12) United States Patent
Lu et al.

(10) Patent No.: US 6,425,606 B1
(45) Date of Patent: Jul. 30, 2002

(54) DIFFRACTIVE ANTI-COUNTERFEITING TAG WITH NAKED-EYE INSPECTION AND MACHINE INSPECTION

(75) Inventors: Ying-Tsung Lu, Kaohsiung; Jeng-Feng Lin, Yunlin Hsien; Pong Lai, Taipei Hsien; Pai-Ping Huang, Hsinchu Hsien; Wann-Diing Tyan, Chiayi; Hoang-Yan Lin, Keelung, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/414,376

(22) Filed: Oct. 7, 1999

(51) Int. Cl.[7] ..... B42D 15/00

(52) U.S. Cl. ..... 283/91; 283/93; 283/901; 428/916

(58) Field of Search ..... 283/91, 92, 93, 283/901; 428/915, 916, 917

(56) References Cited

U.S. PATENT DOCUMENTS 4,568,141 A * 2/1986 Antes ..... 283/91
5,032,003 A * 7/1991 Antes ..... 283/91
5,101,184 A * 3/1992 Antes ..... 283/91
5,127,675 A * 7/1992 Moss ..... 283/70
5,176,405 A * 1/1993 Kaule et al. ..... 283/83
5,335,113 A * 8/1994 Jackson et al. ..... 359/569
5,447,335 A * 9/1995 Haslop ..... 283/91
5,461,239 A * 10/1995 Atherton ..... 250/566
5,502,707 A * 3/1996 Komma et al. ..... 369/103
5,604,345 A * 2/1997 Matsuura ..... 356/374
5,604,829 A * 2/1997 Bruesselbauch ..... 359/569
5,611,575 A * 3/1997 Petrie ..... 283/67
5,661,577 A * 8/1997 Jenkins et al. ..... 359/11
5,742,411 A * 4/1998 Walters ..... 359/2
5,757,523 A * 5/1998 Wood et al. ..... 359/15
5,763,051 A * 6/1998 Reinhart et al. ..... 428/195
5,774,239 A * 6/1998 Feldman et al. ..... 359/9
5,779,965 A * 7/1998 Beuther et al. ..... 264/280
5,784,200 A * 7/1998 Modegi ..... 359/567
5,786,910 A * 7/1998 Walters et al. ..... 283/86
5,794,023 A * 8/1998 Hobbs et al. ..... 359/565
5,808,758 A * 9/1998 Solmsdforf ..... 359/2
5,815,292 A * 9/1998 Walters ..... 283/94
5,825,547 A * 10/1998 Lee ..... 359/567
5,863,075 A * 1/1999 Rich et al. ..... 283/94
5,886,798 A * 3/1999 Staub et al. ..... 283/86
5,915,731 A * 6/1999 Jackson ..... 283/91
6,005,691 A * 12/1999 Grot et al. ..... 359/2
6,036,232 A * 3/2000 Kaule et al. ..... 283/85
6,088,161 A * 7/2000 Lee ..... 359/567

* cited by examiner

*Primary Examiner*—A. L. Wellington
*Assistant Examiner*—Monica Carter
(74) *Attorney, Agent, or Firm*—Jiawei Huang; J.C. Patents

(57) ABSTRACT

A diffractive anti-counterfeiting tag structure with capabilities of naked-eye inspection and machine inspection and its method of manufacture. The anti-counterfeiting tag structure has a naked-eye inspection component and a machine inspection non-grating diffractive component. The naked-eye inspection component and the non-grating diffractive component are formed on separate mold-boards and then joined together to form a mold-board using a board-joining technique. Alternatively, a plurality of naked-eye inspection blocks and a plurality of non-grating diffractive blocks are randomly mixed together to form a pixel-like diffractive anti-counterfeiting tag.

22 Claims, 4 Drawing Sheets

200

200

DIFFRACTIVE ANTI-COUNTERFEITING TAG WITH NAKED-EYE INSPECTION AND MACHINE INSPECTION

CROSS-REFERENCE TO RELATED APPLICATION

This application claims the priority benefit of Taiwan application serial no. 88113558, filed Aug. 9, 1999, the full disclosure of which is incorporated herein by reference.

BACKGROUND OF THE INVENTION

1. Field of Invention

The present invention relates to a type of anti-counterfeiting tag. More particularly, the present invention relates to the structure of a diffractive anti-counterfeiting tag with capabilities of naked-eye inspection and machine inspection and its method of manufacture.

2. Description of Related Art

A hologram is a diffractive component that is frequently used as a means of authenticating products, improving security and preventing unlawful copying activities. For example, the dove on a VISA card and the globe on a Master card are holograms. The hologram on the VISA or Master card is able to prevent counterfeiting activities because it is difficult to copy the image just by scanning or printing. Only professional people who are familiar with holographic techniques can reproduce a hologram.

Nevertheless, a hologram can still be reproduced by copying, although the image copied from an original hologram is likely to have an inferior quality plus other defects. However, to distinguish a genuine hologram from a faked one by naked-eye inspection, specially trained people must be employed. Moreover, people's judgements are often clouded by subjective factors.

In addition to human-eye inspection of hologram, specially hidden patterns can also be added alongside the visible hologram. For example, according to U.S. Pat. No. 4,984,824, an anti-counterfeiting tag having both a visible hologram and a diffractive hidden pattern is proposed. This type of anti-counterfeiting tag must be inspected with a magnifying glass. Aside from the few people who are familiar with the product, very few people are able to pick up the hidden pattern. Moreover, dimensions and details within the area holding the hidden pattern are more precisely manufactured, thereby increasing the level of difficulty for counterfeiting. However, the hidden pattern can still be discerned by careful observation and then faked, and the hidden pattern is similarly assessed by subjective inspectors.

Machine inspection, by comparison, is a more objective method of distinguishing a genuine from a faked pattern. However, due to the necessity of alignment between the machine and the pattern, the aforementioned diffractive hidden pattern is not particularly suitable for machine inspection. To facilitate tag inspection using a machine, a system combining a bar code and a hologram is proposed in U.S. Pat. Nos. 5,306,899 and 5,422,744. The combination of a bar code and a hologram is able not only to increase the level of security for counterfeiting, but objective machine measurement is also possible. Nonetheless, the bar code can be read out by any bar code reader, and so the bar code can be easily reproduced.

In general, a diffractive component is difficult to counterfeit and is also suitable for machine inspection. Hence, diffractive components are very often used on anti-counterfeiting tags in anti-counterfeiting systems. First, a suitable diffractive pattern is designed according to need. Second, a suitable detector is mounted in a position for reading the anti-counterfeiting tag. Third, an analyzing machine is used to judge the genuineness of the tag according to the feedback signals from the detector. Because the analyzing machine for judging the tag is part of the anti-counterfeiting system, the integration of the analyzing machine and the diffractive component increases design flexibility and level of counterfeiting prevention. In addition, efficiency of any copied diffractive components is likely to be lower than the original, and hence can be quite easily singled out by the analyzing machine.

In general, a diffractive anti-counterfeiting tag will produce a collection of lighting spots. For example, according to U.S. Pat. Nos. 5,291,006, 5,300,764 and 5,627,663, the diffractive component of the anti-counterfeiting tag is subdivided into a plurality of blocks. Each of these blocks has a linear diffraction grating that has a different orientation and/or line width. A laser diode or a photodiode is used to illuminate the grating so that a detector array or a diffracted pattern is formed for machine analysis. For example, in the Microtag system as described in Opt. Lett., Jan. 1, 1998, an extreme ultraviolet (EUV) lithographic method is used so that a plurality of blocks of linear diffraction gratings each having a specific line width and phase difference are formed. The analyzing machine comprises a laser diode and a charge-coupled device (CCD). However, the basic unit of the anti-counterfeiting tag is a linear diffraction grating. FIG. 1 is a schematic, top view showing a plurality of the linear diffraction gratings in a conventional anti-counterfeiting tag. Therefore, any would-be counterfeiter can still mark down such information as the orientation, cycle and line width in each diffraction grating block and reproduce the pattern accordingly.

SUMMARY OF THE INVENTION

The present invention provides a diffractive anti-counterfeiting tag structure and a method of fabricating the tag. The diffractive anti-counterfeiting tag comprises a hologram for naked-eye inspection and a non-grating diffractive component for machine inspection. Hence, the tag has double protection against any unlawful copying and counterfeiting.

To achieve these and other advantages and in accordance with the purpose of the invention, as embodied and broadly described herein, the invention provides a diffractive anti-counterfeiting tag structure. The tag includes a hologram and a non-grating diffractive component that are bonded together by a board-joining technique or a random pixel design. Consequently, the hologram and the non-grating diffractive component are integrated together to form a diffractive anti-counterfeiting tag. The hologram permits naked-eye inspection for picking out the counterfeits, while the non-grating diffractive component is able to produce an irregular image permitting an anti-counterfeiting machine to decide upon the question of genuineness. Therefore, the diffractive anti-counterfeiting tag of this invention is doubly protected against copying or counterfeiting.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
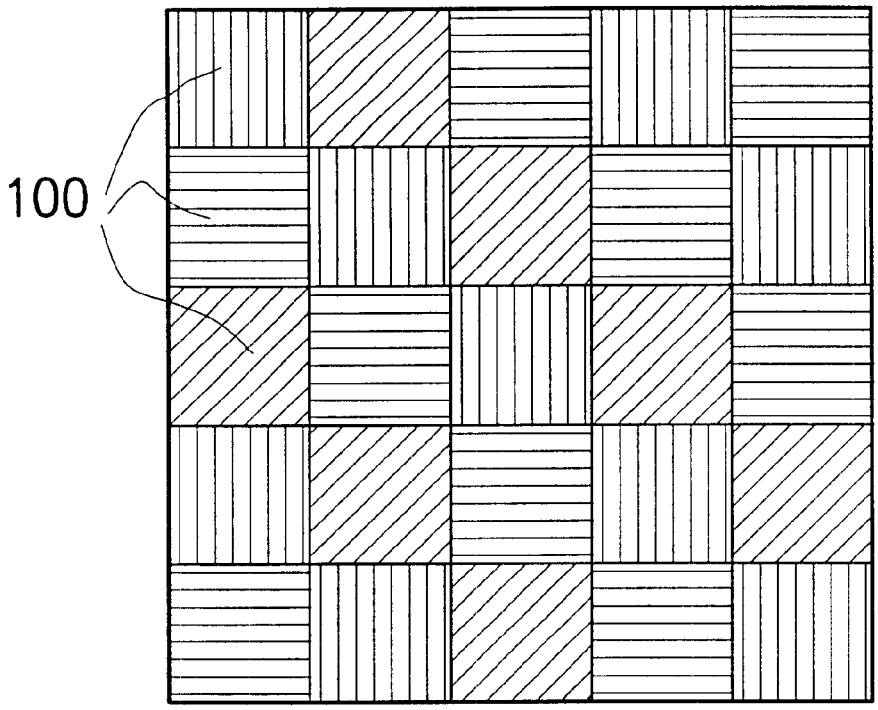
FIG. 1 (PRIOR ART)
FIG. 1 is a schematic, top view showing a plurality of the linear diffraction grating in a conventional anti-counterfeiting tag.

Reference will now be made in detail to the present preferred embodiments of the invention, examples of which are illustrated in the accompanying drawings. Wherever possible, the same reference numbers are used in the drawings and the description to refer to the same or like parts.

The diffractive anti-counterfeiting tag of this invention includes a "naked-eye inspection component" and a "machine inspection diffractive component, and hence is doubly protected. Authenticity of the tag can be decided by a naked-eye inspection or a machine inspection. The naked-eye inspection component can be, for example, a hologram that includes a company logo or a product trademark. The hologram can also serve as a label for finding the machine inspection diffractive component. The naked-eye inspection component can be formed using, for example, holographic photography, point-array interference or semiconductor photolithography.

Figure 2:
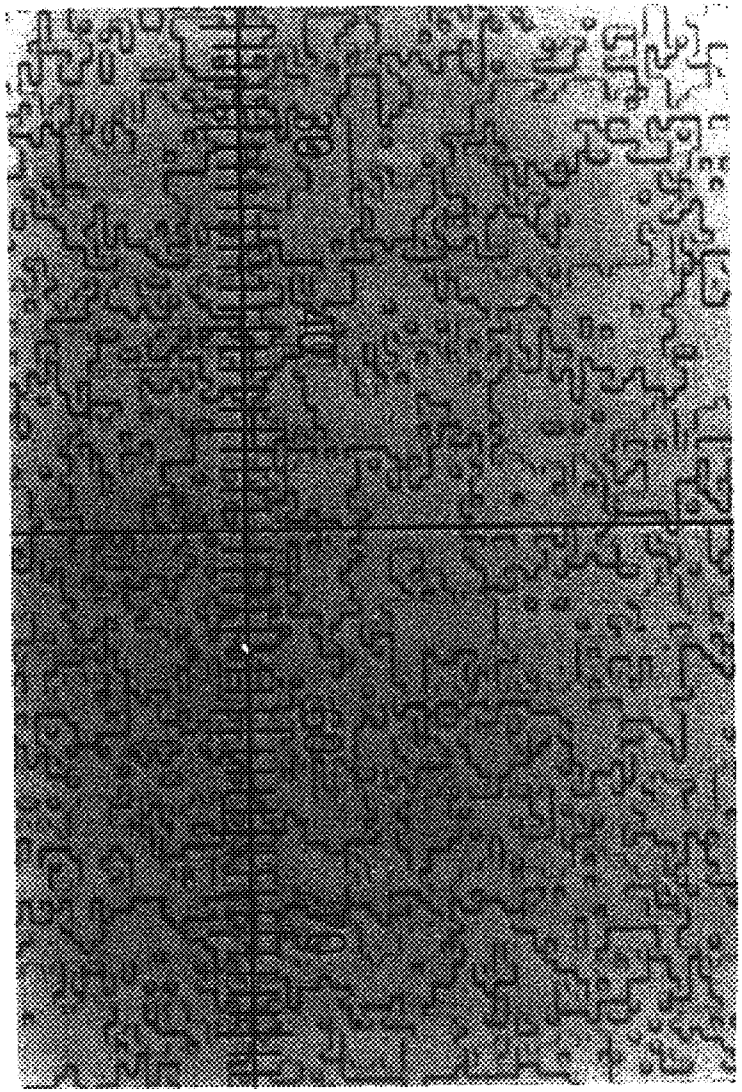
FIG. 2 is a diagram showing the non-grating diffractive component of a diffractive anti-counterfeiting tag according to a first embodiment of this invention.

The machine inspection component is actually a non-grating diffractive component that employs the diffraction theories of Fresnel and Fraunhofer. FIG. 2 is a diagram showing the non-grating diffractive component of a diffractive anti-counterfeiting tag according to a first embodiment of this invention. Since the finished product of a diffractive component is complex and highly irregular, only a monotonous and unappealing surface can be seen. There are no observable images for would-be counterfeiter to follow except some random microstructures. Hence, it would be very difficult to reproduce. Furthermore, the diffractive component cannot be generated by any optical interference method. The non-grating diffractive component can be produced using, for example, photolithographic techniques.

Figure 3:
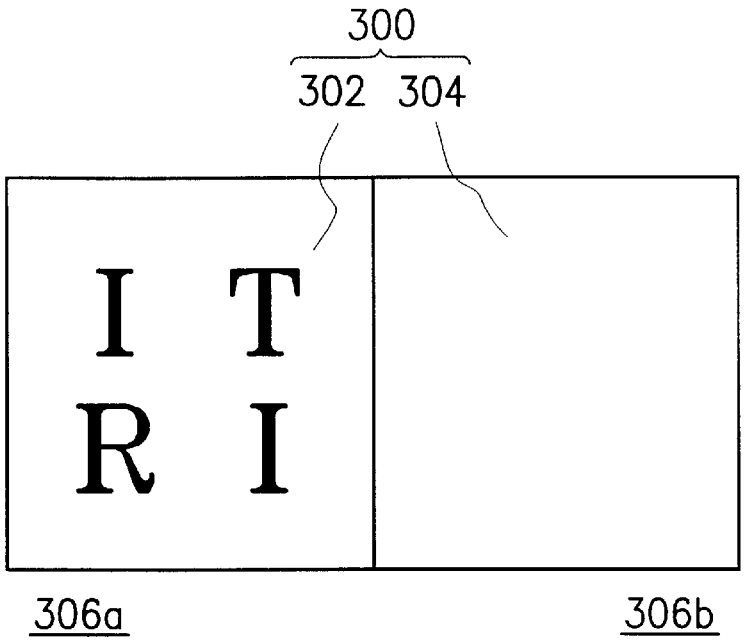
FIG. 3 is a schematic, top view of a diffractive anti-counterfeiting tag structure according to the first embodiment of this invention.

FIG. 3 is a schematic, top view of a diffractive anti-counterfeiting tag structure according to the first embodiment of this invention. The naked-eye inspection component 302 and the machine inspection non-grating diffractive component 304 can be produced separately. The naked-eye inspection component can be a hologram formed using, for example, holographic photography, point-array interference or semiconductor photolithography. The non-grating diffractive component 304 (as shown in FIG. 2) is designed according to the theories of diffraction. After the separate formation of the naked-eye inspection component 302 and the non-grating diffractive component 304, they are bonded next to each other to form a diffractive anti-counterfeiting tag 300. The diffractive component 304 can be, for example, a non-grating type of diffractive component, a linear grating type, or a combination of both of the non-grating type and the linear grating type.

In the first embodiment of this invention, the diffractive anti-counterfeiting tag has a naked-eye inspection hologram and a machine inspection diffractive component sitting next to each other. This arrangement should be regarded as an illustration instead of as limiting the scope of this invention because there can be other variations centered upon this idea.

Figure 4:
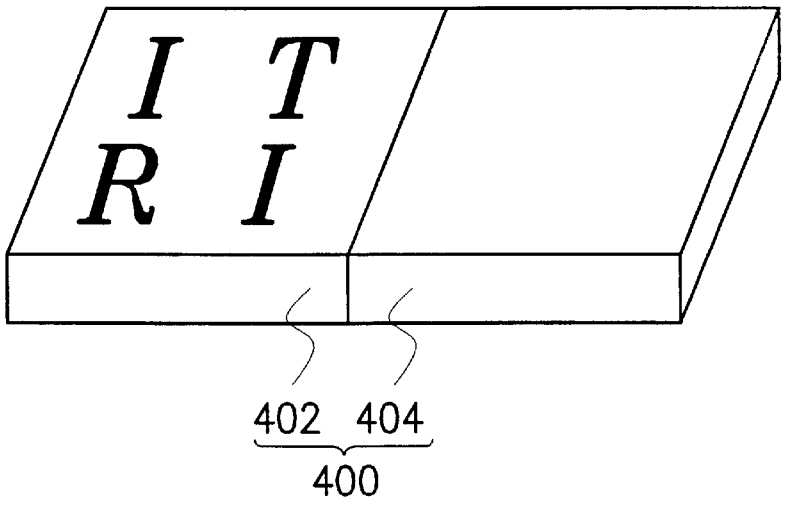
FIG. 4 is a perspective diagram showing a mother board structure for forming a diffractive anti-counterfeiting tag thereon according to the first embodiment of this invention.

FIG. 4 is a perspective diagram showing a mother board structure for forming a diffractive anti-counterfeiting tag thereon according to the first embodiment of this invention. Aside from attaching the separately formed naked-eye inspection component (label 302 in FIG. 3) and machine inspection diffractive component (label 304 in FIG. 3) next to each other to produce a diffractive anti-counterfeiting tag (label 300 in FIG. 3), the naked-eye inspection component can be formed on a first mold-board 402 while the machine inspection diffractive component can be formed on a second mold-board 404. In a subsequent step, the first mold-board 402 and the second mold-board 404 are bonded together to form an anti-counterfeiting mold-board 400 using a board-joining technique so that their respective surfaces are at level with each other. The naked-eye inspection component preferably has a thickness of about 30 $\mu$m, and the technique for joining the mold-boards 402 and 404 includes a hologram board-joining technique.

The single anti-counterfeiting tag on a mold-board formed by the board-joining technique is able to reproduce anti-counterfeiting tags each having identical quality at the mass production stage. The anti-counterfeiting tags are reproduced by an embossing method including heated embossing and roller embossing. By forming the anti-counterfeiting tag on an easily destroyed material layer, copying activities can be further reduced. In addition, by grouping together two different tags into a single tag structure (the naked-eye inspection component and the diffractive component), an anti-counterfeiting threshold relative to a single anti-counterfeiting tag is increased considerably. An additional advantage is the placement of the naked-eye inspection component and the diffractive component next to each other. This facilitates the search for the anti-counterfeiting tag by machines. Furthermore, mass-produced anti-counterfeiting tag can be applied to documents as well. The tag can be glued to or ironed onto the document, for example.

Since the diffractive component cannot be checked by ordinary equipment, a special tag reader that matches the design of the diffractive component must be used to authenticate the tag. Components of the tag include a light source (from a laser diode), optical elements, a detector, a signal-processing circuit and some authentication firmware (not shown in the figure). Note that the optical system within the tag reader must follow a set of codes particularly for authenticating diffractive component. Because the tag reader itself is also part of the anti-counterfeiting system, the tag reader together with the diffractive component is able to provide more flexibility to the design of anti-counterfeiting tags. Consequently, the level of counterfeiting protection is also increased considerably. To authenticate a diffractive anti-counterfeiting tag, a laser beam from the tag reader is sent to the tag. Diffracted light from the tag next enters the detector resulting in the generation of some signals. These signals are regularly sampled and processed inside the signal-processing circuit. Lastly, authentication firmware is used to decide if the tag is genuine or not.

Figure 5:
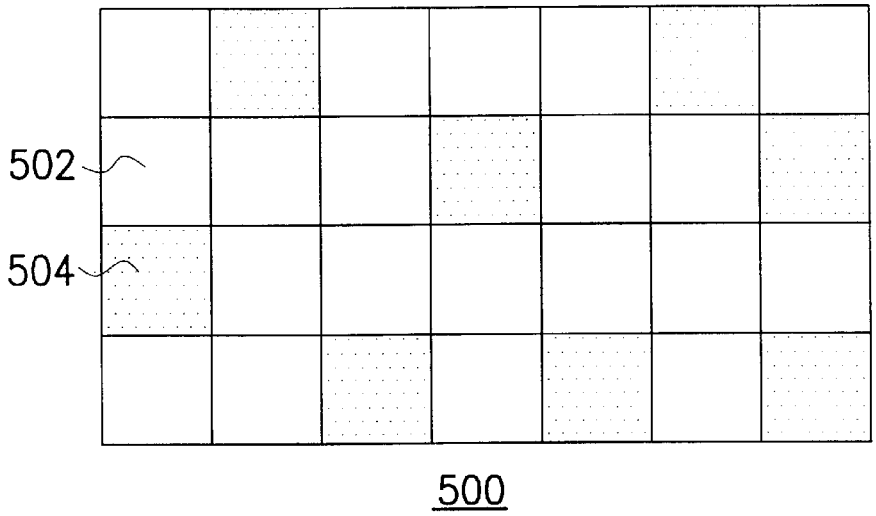
FIG. 5 is a schematic, top view showing a diffractive anti-counterfeiting tag with a random pixel structure according to a second embodiment of this invention.

FIG. 5 is a schematic, top view showing a diffractive anti-counterfeiting tag with a random pixel structure according to a second embodiment of this invention. In the second embodiment, the diffractive anti-counterfeiting tag includes a naked-eye inspection portion 502 and a machine inspection portion 504. The naked-eye inspection portion includes a plurality of holographic blocks. The machine inspection portion includes a plurality of diffractive blocks. Using a random pixel design, these naked-eye inspection blocks 502 and the machine inspection blocks are randomly mixed together to form a pixel-like anti-counterfeiting tag on a substrate 500 using, for example, the photolithographic technique in semiconductor manufacturing.

Figure 6:
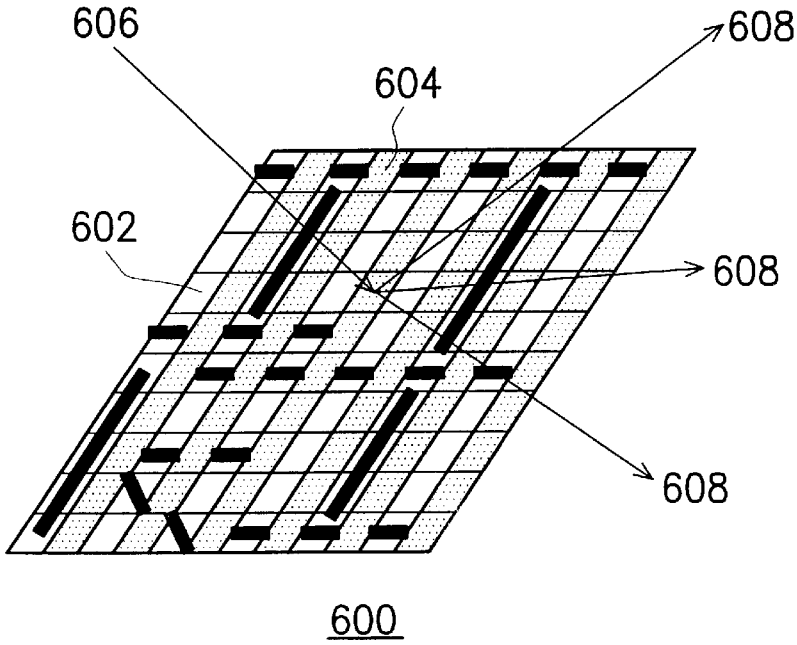
FIG. 6 is a schematic, top view looking from an angle that shows an example of the diffractive anti-counterfeiting tag structure according to the second embodiment of this invention.

FIG. 6 is a schematic, top view looking from an angle that shows an example of the diffractive anti-counterfeiting tag structure according to the second embodiment of this invention. As shown in FIG. 6, a plurality of naked-eye inspection blocks 602 or hologram blocks and a plurality of diffractive blocks are randomly distributed across an anti-counterfeiting tag substrate 600. An image is visible on assimilating the plurality of naked-eye inspection blocks 602. The plurality of diffractive blocks 604 can be inspected through a tag reader without the need for pre-alignment.

The process of authenticating an anti-counterfeiting tag in the second embodiment is also similar to the first embodiment of this invention. First, a laser beam 606 is sent from a light source (a laser diode) inside a tag reader to the diffractive blocks 604. Diffracted light 608 from the diffractive blocks 604 next enters a detector resulting in the generation of some signals. These signals are regularly sampled and processed inside the signal-processing circuit. Lastly, authentication firmware is used to decide if the tag is genuine or not. The anti-counterfeiting tags can be mass-produced by an embossing method including heated embossing and roller embossing. In addition, by forming the anti-counterfeiting tag on an easily destroyed material layer, copying activities can be further reduced. Furthermore, a mass-produced anti-counterfeiting tag can be applied to documents as well. The tag can be glued to or ironed onto the document, for example.

In the second embodiment, the naked-eye inspection blocks and the machine inspection diffractive blocks are distributed across the anti-counterfeiting tag like random pixels. Nevertheless, the schematic views as shown in FIGS. 5 and 6 serve as an illustration only. They should not be construed as a limitation on the ways these blocks must be arranged. In fact, both the design of the naked-eye inspection block and the diffractive block themselves as well as the distribution of these two types of blocks on a tag substrate can have many variations. These variations are combinatorial so that they can also be utilized to provide additional anti-counterfeiting functions beside the double anti-counterfeiting functions provided by the naked-eye inspection component and the machine inspection diffractive component alone.

A comparison of advantages and disadvantages of various types of conventional anti-counterfeiting tags and the anti-counterfeiting tags of this invention is described hereinafter.

| | Advantages | Disadvantages |
|---|---|---|
| Holograms (Naked-Eye inspection) | 1. Cannot be counterfeited by scanning or printing. | 1. Must rely on professionally trained personnel to determine the genuine from the faked; too subjective. |
| Holograms + Hidden Pattern | 1. Cannot be counterfeited by scanning or printing.<br>2. Double anti-counterfeiting function. | 1. Counterfeiting is still possible by carefull observation.<br>2. Non-objective assessment.<br>3. Unsuitable for inspection by machine. |
| Machine inspection diffractive component | 1. Cannot be counterfeited using a scanning or printing method.<br>2. More objective assessment.<br>3. By combining inspection machine structure and diffractive components, both design flexibility and level of anti-counterfeiting improve. | 1. Basic element of a diffractive component is a linear diffraction grating. By carefully observing the microstructures on the diffractive component, such as the orientation, cycle, line width and so on, the diffractive component can still be reproduced. |
| The Invention | 1. Cannot be counterfeited by scanning or printing.<br>2. Much better double anti-counterfeiting function.<br>3. Objective assessment.<br>4. By combining inspection machine structure and diffractive components, both design flexibility and level of anti-counterfeiting improve.<br>5. Due to inefficiency of copied diffractive components, genuine or faked tags can be easily determined by a tag reader.<br>6. Basic element of a diffractive component is no longer simple linear diffraction gratings. Instead, highly complex and irregular patterns are produced such that no microstructures are present for would-be counterfeiter to observe. | |

In summary, the advantages of this invention include:

1. A board-joining technique is used to combine together two types of separately formed anti-counterfeiting components so that a diffractive anti-counterfeiting tag is produced. The tag has double anti-counterfeiting protection. In addition, a high precision board-joining technique and a random pixel design further increases the degree of difficulties for illegal reproduction.

2. When a tag reader is used to authenticate the anti-counterfeiting tag instead of a human inspector, accurate and objective measurements are possible. The combination of naked-eye inspection holograms with diffractive components, the use of board-joining method and the random pixel design facilitate the authentication of an anti-counterfeiting tag using a tag reader.

3. The diffractive components in the invention are no longer an assembly of simple linear diffraction gratings. In fact, the diffractive components are designed into highly complex and irregular pattern according to diffraction theories. It is useless for the would-be counterfeiter to attempt reproduction by looking at the microstructures. Therefore, the anti-counterfeiting tag is more secure against reproduction.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A diffractive and anti-counterfeiting tag, comprising:

a naked-eye inspection component containing an image; and a non-grating diffractive component joined next to the naked-eye inspection component for authentication, the non-grating diffractive component comprising an irregular diffractive image that can only be inspected by an anti-counterfeiting machine.

2. The tag of claim 1, wherein the naked-eye inspection component includes a hologram.

3. The tag of claim 1, wherein the diffractive component includes a non-grating optical component.

4. The tag of claim 1, wherein the diffractive component includes a linear grating optical component.

5. The tag of claim 1, wherein the diffractive component includes a combination of a non-grating optical component and a linear grating optical component.

6. A diffractive anti-counterfeiting tag, comprising:

a plurality of naked-eye inspection blocks capable of forming an image that can be observed by naked eyes; and a plurality of non-grating diffractive blocks randomly mixed together with the naked-eye inspection blocks to form a random pixel-like distribution of blocks ready for authentication, wherein the non-grating diffractive blocks comprise at least a diffractive pattern which can only be observed by a machine.

7. The tag of claim 6, wherein each diffractive block includes a non-grating optical component.

8. The tag of claim 6, wherein each diffractive block includes a linear grating optical component.

9. The tag of claim 6, wherein the diffractive component includes a combination of a non-grating optical component and a linear grating optical component.

10. A method for forming a diffractive anti-counterfeiting tag, comprising the steps of:

forming a naked-eye inspection component comprising an image for being authenticated by naked-eyes;

forming a non-grating diffractive component comprising an irregular diffractive image for being only authenticated by machines; and joining the naked-eye inspection component and the non-grating diffractive component adjacent to each other to form an integrated tag.

11. The method of claim 10, wherein the step of forming the naked-eye inspection component includes taking holographic photographs.

12. The method of claim 10, wherein the step of forming the naked-eye inspection component includes performing a point-array interference.

13. The method of claim 10, wherein the step of forming the naked-eye inspection component includes performing a photolithographic operation.

14. The method of claim 10, wherein the step of forming the diffractive component includes performing photolithographic operations.

15. A method for forming a diffractive anti-counterfeiting tag, comprising the steps of:

providing a substrate; and forming a plurality of naked-eye inspection blocks and a plurality of non-grating diffractive blocks on the substrate such that the naked-eye inspection blocks and the non-grating blocks are mixed together to form a random pixel-like distribution, wherein the non-grating blocks comprises a specific diffractive pattern being only recognized by a machine.

16. The method of claim 15, wherein the step of forming the naked-eye inspection blocks and the diffractive blocks includes performing a photolithographic operation.

17. A method for forming a diffractive anti-counterfeiting tag, comprising the steps of:

forming a naked-eye inspection component comprising an image that can observed by naked eyes on a first mold-board;

forming a diffractive component on a second mold-board, wherein the diffractive component comprises a diffractive pattern that can only be observed by a machine; and joining the first mold-board and the second mold-board next to each other such that a top surface of the first mold-board and a top surface of the second mold-board are level with each other.

18. The method of claim 17, wherein the step of joining the first mold-board and the second mold-board includes using a holographic board-joining technique.

19. A method for forming a diffractive anti-counterfeiting tag, comprising the steps of:

forming a naked-eye inspection component on a first mold-board;

forming a non-grating diffractive component on a second mold-board, wherein the diffractive component comprises a diffractive pattern that can only be observed by a machine;

joining the first mold-board and the second mold-board next to each other such that a top surface of the first mold-board and a top surface of the second mold-board are level with each other, where the first mold-board and the second mold-board form an integrated mold board; and forming the diffractive anti-counterfeiting tag by an embossing process with the integrated mold board.

20. The method of claim 19, wherein the step of joining the first mold-board and the second mold-board includes using a holographic board-joining technique.

21. The method of claim 19, wherein the embossing process comprises heated embossing.

22. The method of claim 19, wherein the embossing process comprises rolling embossing.

* * * * *

UNITED STATES PATENT AND TRADEMARK OFFICE

CERTIFICATE OF CORRECTION

PATENT NO. : 6,425,606 B1
APPLICATION NO. : 09/414376
DATED : July 30, 2002
INVENTOR(S) : Lu et al.

It is certified that error appears in the above-identified patent and that said Letters Patent is hereby corrected as shown below:

Title Page: item (30), Foreign Application Priority Data "Aug. 9, 1999 [TW] Taiwan 88113558" should be added.

Signed and Sealed this

Third Day of February, 2009

John Doll

JOHN DOLL
*Acting Director of the United States Patent and Trademark Office*